US008640657B2

(12) United States Patent
Huhn et al.

(10) Patent No.: US 8,640,657 B2
(45) Date of Patent: Feb. 4, 2014

(54) OIL SUPPLY SYSTEM FOR AN INTERNAL COMBUSTION ENGINE

(75) Inventors: Werner Huhn, Bondorf (DE); Peter Krauss, Sternenfels (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 200 days.

(21) Appl. No.: 13/154,862

(22) Filed: Jun. 7, 2011

(65) Prior Publication Data

US 2011/0297119 A1 Dec. 8, 2011

(30) Foreign Application Priority Data

Jun. 8, 2010 (DE) ..... 10 2010 023 063

(51) Int. Cl.

| | |
|---|---|
| ***F01P 11/08*** | (2006.01) |
| ***F01P 1/04*** | (2006.01) |
| ***F01M 1/02*** | (2006.01) |
| ***F01M 1/04*** | (2006.01) |
| ***F01M 5/00*** | (2006.01) |

(52) U.S. Cl.

USPC ..... 123/41.33; 123/41.35; 123/196 R; 123/196 CP; 123/196 AB; 123/196 M; 123/196 V

(58) Field of Classification Search

USPC ..... 123/41.33, 41.35, 196 R, 196 CP, 123/196 AB, 196 M, 196 V

See application file for complete search history.

(56) References Cited

U.S. PATENT DOCUMENTS

| | | | | | |
|---|---|---|---|---|---|
| 2,188,172 | A | * | 1/1940 | Brehob | 123/196 AB |
| 3,065,743 | A | * | 11/1962 | Brehm et al. | 123/41.08 |
| 3,485,324 | A | * | 12/1969 | Novak | 184/6 |
| 4,114,571 | A | * | 9/1978 | Ruf | 123/41.35 |
| 4,126,997 | A | * | 11/1978 | Henson | 60/605.3 |
| 4,270,562 | A | * | 6/1981 | Oberth et al. | 137/115.16 |
| 4,453,511 | A | * | 6/1984 | Pluequet | 123/196 S |

(Continued)

FOREIGN PATENT DOCUMENTS

| | | |
|---|---|---|
| DE | 97262 | 4/1973 |
| DE | 102005048019 | 4/2007 |

(Continued)

OTHER PUBLICATIONS

DE 102008032496; Jan. 7, 2010: Computer translation.*

(Continued)

*Primary Examiner* — Thanh Truong
*Assistant Examiner* — Tea Holbrook
(74) *Attorney, Agent, or Firm* — RatnerPrestia

(57) ABSTRACT

An oil supply system for an internal combustion engine includes an oil pump, a heat exchanger, an oil feed line and two oil outlet lines, for conveying the oil from the oil pump through the oil feed line to the heat exchanger and from the latter through the two oil outlet lines. In a system of this type, there is provision for the internal combustion engine to be configured as a piston engine and for the heat exchanger to be configured as a water/oil heat exchanger, and for one oil outlet line to be connected to oil spray nozzles of the piston engine and for the other oil outlet line to be connected to a main oil line of the piston engine. An oil supply system of this type is distinguished by its simple design and functionality, and permits optimum cooling and lubrication of the relevant components of the engine.

10 Claims, 1 Drawing Sheet

(56) References Cited

U.S. PATENT DOCUMENTS

| | | | | | |
|---|---|---|---|---|---|
| 4,708,095 | A * | 11/1987 | Luterek | 123/41.42 |
| 5,220,891 | A * | 6/1993 | Nakamura et al. | 123/90.16 |
| 5,483,928 | A * | 1/1996 | Mahlberg et al. | 123/41.42 |
| 6,955,150 | B2 * | 10/2005 | Moss | 123/196 AB |
| 7,111,669 | B2 * | 9/2006 | Hoglinger et al. | 165/140 |
| 7,198,020 | B1 * | 4/2007 | Beddick | 123/196 R |
| 7,798,289 | B2 * | 9/2010 | Wieg et al. | 184/6.5 |
| 2005/0006067 | A1 * | 1/2005 | Hoglinger et al. | 165/140 |
| 2005/0039719 | A1 * | 2/2005 | Moss | 123/196 AB |
| 2008/0245613 | A1 * | 10/2008 | Rutschmann et al. | 184/6.5 |

FOREIGN PATENT DOCUMENTS

| | | | | |
|---|---|---|---|---|
| DE | 102008032496 | * | 1/2010 | F01M 5/00 |
| DE | 102010012661 | * | 12/2010 | F01M 5/00 |
| JP | 08144730 A | * | 6/1996 | F01M 1/16 |

OTHER PUBLICATIONS

DE 102010012661; Dec. 16, 2010: Computer translation.*

German Search Report issued on Jan. 27, 2011, in related Application No. DE 10 2010 023 063.4, filed Jun. 8, 2010.

* cited by examiner

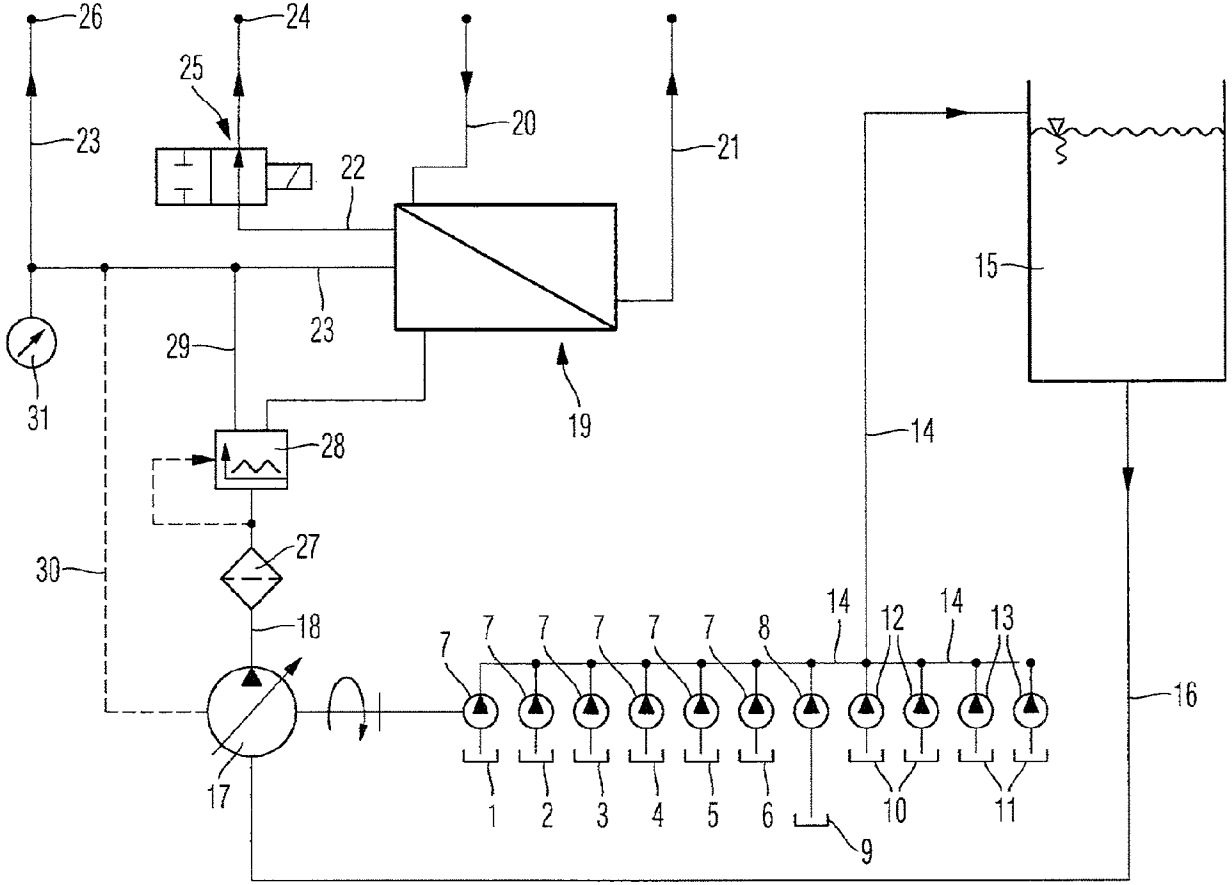
16
15
14
13
11
12
10
9
8
7
6
5
4
3
2
1
21
20
19
22
23
24
25
26
28
27
18
17
29
30
31

OIL SUPPLY SYSTEM FOR AN INTERNAL COMBUSTION ENGINE

CROSS-REFERENCE TO RELATED APPLICATION

This U.S. patent application claims priority to German Patent Application DE 102010023063.4, filed Jun. 8, 2010, which is incorporated by reference herein in its entirety.

FIELD OF INVENTION

The invention relates to an oil supply system for an internal combustion engine, having an oil pump, a heat exchanger, an oil feed line and two oil outlet lines, for conveying the oil from the oil pump through the oil feed line to the heat exchanger and from the latter through the two oil outlet lines.

BACKGROUND OF THE INVENTION

An oil supply system of this type is known from DE 10 2005 048 019 A1, which is incorporated by reference herein. There, oil is fed from an oil tank via the oil pump to individual consumers, and is guided from the latter via a return line back into the oil tank. Here, the oil is guided in a heat exchanger. The respective oil feed temperature to the respective consumer is regulated/controlled in such a way that the result is a substantially identical oil outlet temperature for the individual consumers.

In the case of internal combustion engines which are configured as piston engines, the oil which is fed to the piston engine serves primarily to lubricate moving components of the piston engine. Furthermore, the oil can serve to cool highly thermally loaded components of the piston engine. In the case mentioned last, oil spray nozzles are used which spray oil onto the components in their highly thermally loaded regions.

SUMMARY OF THE INVENTION

It is an object of the invention to provide an oil supply system for a piston engine, which oil supply system permits optimum cooling and lubrication of the relevant components of the piston engine with a simple design and functionality.

This object is achieved by an oil supply system for an internal combustion engine, having an oil pump, a heat exchanger, an oil feed line, a first oil outline line and a second oil outlet lines, for conveying the oil from the oil pump through the oil feed line to the heat exchanger and from the heat exchanger through the two oil outlet lines, wherein the internal combustion engine is configured as a piston engine and the heat exchanger is configured as a water/oil heat exchanger, and the first oil outlet line is connected to oil spray nozzles of the piston engine and the second oil outlet line is connected to a main oil line of the piston engine.

According to aspects of the invention, the oil supply system is therefore used in an internal combustion engine which is configured as a piston engine. Here, the heat exchanger is configured as a water/oil heat exchanger. Accordingly, the oil which flows through the heat exchanger is cooled by means of water. In particular, cooling water of the piston engine is used to cool the oil. The piston engine is, in particular, a constituent part of a land vehicle. The latter is preferably a passenger car.

According to aspects of the invention, one oil outlet line is connected to oil spray nozzles of the piston engine. The oil which is fed to the oil spray nozzles serves, in particular, to cool the pistons of the piston engine and optionally additionally to cool the bores of the pistons in the cylinders. The other oil outlet line is connected to the main oil line of the piston engine. This other oil outlet device therefore leads to those moving components of the piston engine which are to be lubricated. These are, for example, the main bearings, camshaft bearings, camshaft adjusters, hydraulic compensation elements in the cylinder head, a high pressure pump for the fuel injection, etc.

The components which are to be lubricated via the main oil line are subjected to other thermal loadings than those which are to be cooled by means of the oil spray nozzles. Under this aspect, one advantageous development of the invention provides for the two outlets from the heat exchanger which are assigned to the two oil outlet lines to be arranged in different regions of the heat exchanger in such a way that colder oil emerges through the oil outlet line to the oil spray nozzles than through the oil outlet line to the main oil line.

In certain operating states, the components of the piston engine which are optionally exposed to very high thermal loadings are exposed to only relatively low thermal loadings. In this case, it is not necessary to cool these components, with the result that there is provision under this aspect for it to be possible to shut off the oil outlet line to the oil spray nozzles by means of a valve. The valve releases the oil outlet line only when the cooling effect is desired. Two switchable oil spray nozzles which are controlled by characteristic diagram are preferably provided per cylinder of the piston engine. The oil supply system is designed in a structurally particularly simple way if an oil filter is arranged downstream of the oil pump, between the latter and the heat exchanger. Accordingly, it is only necessary to provide an oil filter at that point, at which the common oil feed line is situated.

There is provision according to one preferred modification of the oil supply system according to aspects of the invention for, downstream of the oil pump, an auxiliary oil feed line to connect the feed line to the oil outlet line from the heat exchanger to the main oil line. In addition, a thermostat is expediently provided for controlling the oil throughflow through the oil feed line to the heat exchanger and through the auxiliary oil feed line. The thermostat makes it possible, in particular, to keep the warming up losses as low as possible. Thus, in the starting phase of the piston engine, relatively cold oil from the oil pump is not pumped via the heat exchanger, but rather is branched off through the auxiliary oil feed line in front of the heat exchanger. From there, the oil firstly passes directly to the main oil line, and furthermore via the heat exchanger to the oil spray nozzles. If the valve in the inflow line to the oil spray nozzles is closed, flow does not pass through the heat exchanger and the oil passes completely from the thermostat, and therefore from the auxiliary oil feed line, to the main oil line. Only when the heating of the oil increases, the thermostat releases the direct access to the heat exchanger and closes the auxiliary oil feed line.

A measuring device is expediently provided for detecting the temperature and the pressure of the oil in the main oil line. The determined values are transmitted to a control unit of the engine controller.

The piston engine is, in particular, a piston engine with dry sump lubrication. In the latter, there is provision for the oil to be conveyed from the dry sump via suction stages to an oil tank, and for the oil tank to be connected to the oil pump via a connecting line. Regardless of this, the oil supply system according to aspects of the invention can also be used in a wet sump lubrication means.

It is therefore of particular advantage that the oil thermostat serves to control the temperature of the oil spray nozzle oil and of the engine lubricating oil. Here, the oil spray nozzles can be switched. A colder oil temperature level for the oil spray nozzles to a warmer oil temperature level for the engine lubricating oil can be realized by two different taps of the heat exchanger outlet.

Substantial functional advantages of piston cooling optimization result during driving operation on account of two switchable oil spray nozzles per cylinder, which oil spray nozzles are controlled by characteristic diagram, with the result that lightweight pistons can be realized; furthermore, on account of the improvement in the raw emissions as a result of more rapid component heating, associated with shorter catalytic converter heating times. Moreover, the more rapid warming up leads to an improvement in the consumption of the piston engine.

BRIEF DESCRIPTION OF THE DRAWINGS

Further features of the invention result from the subclaims, the appended drawing and the description of the exemplary embodiment which is represented in the drawing, without being restricted thereto.

In the drawing:

The drawing FIGURE shows a circuit diagram of the oil supply system according to aspects of the invention for an internal combustion engine which is configured as a boxer engine.

DETAILED DESCRIPTION OF THE PREFERRED EMBODIMENTS

The six crankcases 1, 2, 3, 4, 5 and 6 are illustrated for the boxer engine with dry sump lubrication which has six cylinders, each of the six crankcases being assigned a suction stage 7. Furthermore, a further suction stage 8 is provided which extracts oil from the oil sump 9 of the boxer engine. Finally, the two cylinder heads 10 and 11 are assigned in each case two suction stages 12 and 13, respectively. One suction stage 12 is arranged at the front in the cylinder head 10 and the other suction stage 12 is arranged at the rear in the cylinder head 10, in order to extract the oil from said cylinder head. Accordingly, one suction stage 13 is arranged at the front in the cylinder head 11 and the other suction stage 13 is arranged at the rear in the cylinder head 11.

The suction stages 7, 8, 12 and 13 suck the oil into a common oil collecting line 14 and from there into an oil tank 15. A connecting line 16 leads from the bottom of the oil tank 15 to a regulated oil pump 17 which sucks the oil out of the connecting line 16 and feeds it to an oil feed line 18. Said oil feed line 18 connects the oil pump 17 to a heat exchanger 19 which is configured as a water/oil heat exchanger. A water feed line to the heat exchanger 19 is denoted by the designation 20 and a water discharge line from the heat exchanger 19 is denoted by the designation 21. Said two lines 20 and 21 form a constituent part of the cooling water circuit of the boxer engine.

The heat exchanger 19 is connected to two oil outlet lines 22 and 23. The two outlets from the heat exchanger 19 which are assigned to the two oil outlet lines 22 and 23 are arranged in different regions of the heat exchanger 19; this is in such a way that the oil which emerges through the oil outlet line 22 is colder than the oil which emerges through the oil outlet line 23. The oil outlet line 22 is connected to oil spray nozzles 24, two oil spray nozzles 24 which can be switched in a manner controlled by characteristic diagram being provided per cylinder. Each individual oil spray nozzle 24 can be shut by means of an associated valve 25, only one oil spray nozzle 24 with valve 25 being shown in the drawing for reasons of simplification. Said valve 25 can be switched electrically between a position which shuts the throughflow through the oil outlet line 22 and a position which releases said throughflow. If oil is conveyed to the oil spray nozzles 24, spray said oil against the associated piston of the boxer engine and cool the latter. Oil is optionally also sprayed against the cylinder bore for the respective piston, for the purpose of cooling the bore.

The other oil outlet line 23 which emanates from the heat exchanger 19 is connected to a main oil line 26 of the boxer engine. The lubrication of the relevant components of the boxer engine therefore takes place via said oil outlet line 23, in particular the lubrication of the rotating components, such as main bearing, camshaft bearing, camshaft adjuster, hydraulic compensation elements in the cylinder head, high pressure pump for fuel injection.

An oil filter 27 is assigned to the oil feed line 18 downstream of the oil pump 17, and a thermostat 28 is assigned to the oil feed line 18 downstream of the oil filter 27. In the region of the thermostat 28, an auxiliary oil feed line 29 which is connected to the oil outlet line 23 branches off from the oil feed line 18. In the warming up phase of the boxer engine, the thermostat 28 serves to control the oil throughflow. In the case of a relatively cold engine, the oil is conveyed from the pump 17 through the oil feed line 18 and the auxiliary oil feed line 29 to the oil outlet line 23, it being possible in this case for the oil to flow from the connecting point of the auxiliary oil feed line 29 and the oil outlet line 23 firstly to the main oil line 26, and secondly via the oil outlet line 23 to the heat exchanger 19 and from there via the oil outlet line 22 to the oil spray nozzles 24. In the case of a higher oil temperature, the auxiliary oil feed line 29 is closed via the thermostat 28, and the oil is fed completely from the oil pump 17 via the oil feed line 18 to the heat exchanger 19 and branches off there to the oil outlet lines 22 and 23 and passes via the latter to the oil spray nozzles 24 or to the main oil line 26.

A connecting line 30 between the oil pump 17 and the oil outlet line 23 downstream of the junction point of the oil outlet line 23 and the auxiliary oil feed line 29 is shown using dashed lines. A reference pressure for controlling the pump 17 is detected via this connecting line. A sensor 31 is arranged downstream of the junction point of the connecting line 30 and the oil outlet line 23, by way of which sensor 31 the oil temperature and the pressure of the oil are detected for a control unit of the engine.

The engine oil which emerges through the oil spray nozzles 24 and the main oil line 26 is collected in the crankcases 1 to 6, the oil sump 9 and the cylinder heads 10 and 11, whereby the oil circuit of the boxer engine is closed.

LIST OF DESIGNATIONS

1 Crankcase
2 Crankcase
3 Crankcase
4 Crankcase
5 Crankcase
6 Crankcase
7 Suction stage
8 Suction stage
9 Oil sump
10 Cylinder head
11 Cylinder head
12 Suction stage
13 Suction stage
14 Oil collecting line
15 Oil tank

16 Connecting line
17 Oil pump
18 Oil feed line
19 Heat exchanger
20 Water feed line
21 Water discharge line
22 Oil outlet line
23 Oil outlet line
24 Oil spray nozzle
25 Valve
26 Main oil line
27 Oil filter
28 Thermostat
29 Auxiliary oil feed line
30 Connecting line
31 Sensor

The invention claimed is:

1. An oil supply system for an internal combustion engine, having an oil pump, a heat exchanger, an oil feed line, a first oil outlet line and a second oil outlet line, for conveying the oil from the oil pump through the oil feed line to the heat exchanger and from the heat exchanger through the two oil outlet lines, wherein the internal combustion engine is configured as a piston engine and the heat exchanger is configured as a water/oil heat exchanger, and the first oil outlet line is connected to oil spray nozzles of the piston engine and the second oil outlet line is connected to a main oil line of the piston engine, wherein an oil filter is arranged downstream of the oil pump, between the oil pump and the heat exchanger.

2. The oil supply system as claimed in claim 1, wherein, downstream of the oil pump, an auxiliary oil feed line connects the oil feed line to the second oil outlet line from the heat exchanger to the main oil line.

3. The oil supply system as claimed in claim 2, wherein a thermostat is provided for controlling the oil throughflow through the oil feed line to the heat exchanger and through the auxiliary oil feed line.

4. The oil supply system as claimed in claim 1, wherein the first oil outlet line is configured to be fluidly disconnected from the oil spray nozzles by a valve.

5. The oil supply system as claimed in claim 1, wherein two oil spray nozzles, which are configured to be switched in a manner controlled by characteristic diagram, are provided per cylinder of the piston engine.

6. The oil supply system as claimed in claim 1, wherein the two outlets from the heat exchanger, which are assigned to the oil outlet lines, are arranged in different regions of the heat exchanger, wherein a greater proportion of colder oil enters into the first oil outlet line to the oil spray nozzles than enters into the second oil outlet line to the main oil line.

7. The oil supply system as claimed in claim 1, wherein a measuring device is provided for detecting a temperature and a pressure of the oil in the second oil outlet line and/or the main oil line.

8. The oil supply system as claimed in claim 1, wherein the piston engine has dry sump lubrication.

9. The oil supply system as claimed in claim 8, wherein the oil is conveyed from the dry sump via suction stages to an oil tank, and the oil tank is connected to the oil pump via a connecting line.

10. The oil supply system as claimed in claim 1, wherein the piston engine is a boxer engine.

* * * * *